US006471334B2

(12) United States Patent
Kline et al.

(10) Patent No.: US 6,471,334 B2
(45) **Date of Patent: *Oct. 29, 2002**

(54) METHOD AND APPARATUS FOR HORIZONTALLY LOADING AND UNLOADING AN INK-JET PRINT CARTRIDGE FROM A CARRIAGE

(75) Inventors: Daniel S Kline, Encinitas, CA (US); Ram Santhanam, San Diego, CA (US); Junji Yamamoto, San Diego, CA (US); Chee Meng Chen, Singapore (SG)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/872,959

(22) Filed: May 31, 2001

(65) Prior Publication Data

US 2002/0030718 A1 Mar. 14, 2002

Related U.S. Application Data

(63) Continuation of application No. 09/477,649, filed on Jan. 5, 2000, now Pat. No. 6,296,345.

(51) Int. Cl.[7] ..... B41J 2/01
(52) U.S. Cl. ..... 347/49
(58) Field of Search ..... 347/49, 50, 85, 347/86, 87

(56) References Cited

U.S. PATENT DOCUMENTS

| | | | | |
|---|---|---|---|---|
| 4,706,097 A | | 11/1987 | Harmon | 346/139 C |
| 4,755,836 A | | 7/1988 | Ta et al. | 347/49 |
| 4,872,026 A | | 10/1989 | Rasmussen et al. | 347/56 |
| 4,907,018 A | | 3/1990 | Pinkerpell et al. | 346/139 R |
| 5,392,063 A | | 2/1995 | Rhoads | 347/49 |
| 5,561,450 A | | 10/1996 | Brewster, Jr. et al. | 347/49 |
| 5,815,183 A | | 9/1998 | Sasaki | 347/86 |
| 5,825,388 A | | 10/1998 | Sasaki | 347/86 |
| 5,949,459 A | | 9/1999 | Gasvoda et al. | 347/86 |
| 6,070,974 A | | 6/2000 | Kotaki et al. | 347/86 |
| 6,142,600 A | | 11/2000 | Takahashi et al. | 347/23 |
| 6,296,345 B1 | * | 10/2001 | Kline et al. | 347/49 |

FOREIGN PATENT DOCUMENTS

| | | |
|---|---|---|
| EP | 0 604940 | 5/1997 |
| EP | 0 519457 | 9/1997 |
| EP | 0 610965 | 12/1999 |
| JP | 3-184873 | 8/1991 |

* cited by examiner

*Primary Examiner*—Anh T. N. Vo

(57) ABSTRACT

An apparatus for horizontally loading and unloading an ink-jet print cartridge from a carriage in a printer. The apparatus includes a generally rectangular print cartridge, an elongate supporting lip located on a side wall of the print cartridge, a carriage body, a chute mounted on the carriage for receiving the print cartridge, and a generally horizontal rail on a side wall of the chute for guiding the print cartridge into the carriage. In operation, the apparatus horizontally loads a print cartridge into a carriage by translating the print cartridge horizontally forward into a carriage, engaging a lip on the print cartridge with a guide rail on the carriage, sliding the print cartridge up and over a datum on the carriage with the guide rail and latching the print cartridge in the carriage. The apparatus unloads a print cartridge from a carriage by rotating the print cartridge about a datum on the carriage, unlatching the print cartridge from the carriage, and horizontally translating the print cartridge out of the carriage.

27 Claims, 16 Drawing Sheets

METHOD AND APPARATUS FOR HORIZONTALLY LOADING AND UNLOADING AN INK-JET PRINT CARTRIDGE FROM A CARRIAGE

This is a continuation of application No. 09/477,649, filed Jan. 5, 2000, now U.S. Pat. No. 6,296,345.

RELATED APPLICATIONS

This application is related to the following copending utility patent applications, each filed concurrently on Jan. 5, 2000:

Ser. No.: 09/477,645, by Ram Santhanam et al., entitled "Vent For An Ink-Jet Print Cartridge";

Ser. No.: 09/477,646, by Ram Santhanam et al., entitled "Ink-Jet Print Cartridge Having A Low Profile";

Ser. No.: 09/477,644, by Junji Yamamoto et al., entitled "Horizontally Loadable Carriage For An Ink-Jet Printer";

Ser. No.: 09/478,148, by Richard A. Becker et al., entitled "Techniques For Providing Ink-Jet Cartridges With A Universal Body Structure";

Ser. No.: 09/477,843, by Ram Santhanam et al., entitled "Techniques For Adapting A Small Form Factor Ink-Jet Cartridge For Use In A Carriage Sized For A Large Form Factor Cartridge";

Ser. No.: 09/478,190, by James M. Osmus, entitled "Printer With A Two Roller, Two Motor Paper Delivery System";

Ser. No.: 09/477,860, by Keng Leong Ng, entitled "Low Height Inkjet Service Station";

Ser. No.: 09/477648, by Matt Shepherd et al., entitled "New Method of Propelling An Inkjet Printer Carriage";

Ser. No.: 29/116,564, by Ram Santhanam et al., entitled "Ink Jet Print Cartridge"; and Ser. No.: 09/477,940, by Ram Santhanam et al., entitled "Multiple Bit Matrix Configuration For Key-Latched Printheads", all of which are incorporated by reference.

FIELD OF INVENTION

The present invention generally relates to inkjet printers and, more particularly, to the components and subsystems therein.

BACKGROUND OF THE INVENTION

The general construction and operation of an ink-jet print cartridge using reticulated polyurethane foam is disclosed in U.S. Pat. No. 4,771,295 entitled "Thermal Ink Jet Pen Body Construction Having Improved Ink Storage and Feed Capacity" by Baker et al. issued Sep. 13, 1988.

The general design and construction of carriages that retain and align ink-jet print cartridges in printers and scan these print cartridges through print zones is well known. Examples of the patents that have issued in this field of technology include:

U.S. Pat. No. 4,755,836 entitled "Printhead Cartridge and Carriage Assembly" by Ta et al. issued Jul. 5, 1988.

U.S. Pat. No. 4,872,026 entitled "Ink-jet Printer with Printhead Carriage Alignment Mechanism" by Rasmussen et al. issued Oct. 3, 1989.

U.S. Pat. No. 4,907,018 entitled "Printhead-Carriage Alignment and Electrical Interconnect Lock-in Mechanism" by Pinkerpell issued Mar. 6, 1990.

U.S. Pat. No. 5,392,063 entitled "Spring Cartridge Clamp for Inkjet Printer Carriage" by Rhoads issued Feb. 21, 1995.

Prior carriages have been designed to be loaded and unloaded either vertically or with a steep, inclined, arcuate motion. Such carriages have proven to be satisfactory as long as vertical access to the printer is provided. This has meant, however, that nothing could be permanently stacked on top of the printer.

Further, previous top loading ink-jet printer designs have fostered an increasing growth in printer height so that with each new printer design, the profile of the product grew and grew.

Additionally, it is believed that end users want a printer for home use that can be stacked in an entertainment center or used in living rooms. This is a printer that has flat top and bottom walls, that is front loading with all controls and status indicators on the front wall, and that is about the same size as a conventional stereo amplifier or a video cassette recorder (VCR). In other words, this is a horizontally loadable ink-jet printer with an overall height of less than four inches (4").

Such requirements result in numerous design challenges. First, nearly all existing datum structures on present day ink-jet print cartridges are designed for vertical or near vertical installation. Front or horizontal loading has heretofore not been contemplated so if an existing datum structure is to be used, the print cartridge must be positioned in an entirely new manner. Second, on a front loading printer the field of view available to a user during cartridge installation is quite restricted. The user sees less of the carriage and less of the loading process. Third, physical access to the carriage is more limited. Fourth, if multiple print cartridges are used, they must sit so close together that much of their gripping surfaces is unavailable for unloading the print cartridge from the printer.

Thus, it is apparent from the foregoing that although there are many different carriage designs, designing a front loading, stackable, low height ink-jet printer presents many challenges.

SUMMARY OF THE INVENTION

Briefly and in general terms, an apparatus according to the invention includes a generally rectangular print cartridge, an elongate supporting lip located on a side wall of the print cartridge, a carriage body, a chute mounted on the carriage for receiving the print cartridge, and a generally horizontal rail on a side wall of the chute for guiding the print cartridge into the carriage.

In operation, the apparatus horizontally loads a print cartridge into a carriage by translating the print cartridge horizontally forward into a carriage, engaging a lip on the print cartridge with a guide rail on the carriage, sliding the print cartridge up and over a datum on the carriage with the guide rail and latching the print cartridge in the carriage. The apparatus unloads a print cartridge from a carriage by rotating the print cartridge about a datum on the carriage, unlatching the print cartridge from the carriage, and horizontally translating the print cartridge out of the carriage.

Other aspects and advantages of the invention will become apparent from the following detailed description, taken in conjunction with the accompanying drawings, illustrating by way of example the principles of the invention.

DESCRIPTION OF THE PREFERRED EMBODIMENTS

Figure 1:
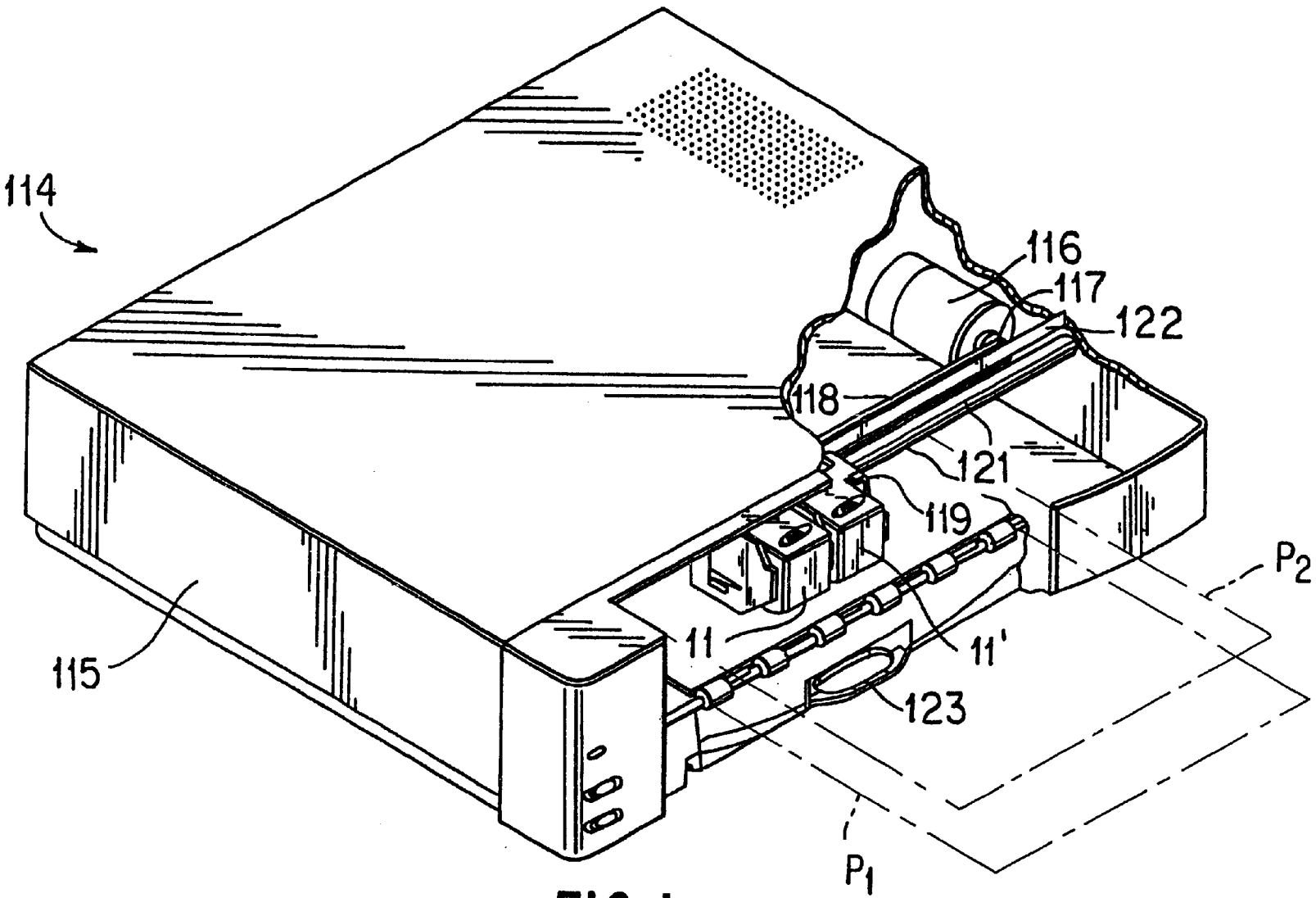
FIG. 1 is a perspective view, in section and partially cut away, of an ink-jet printer embodying the principles of the invention.

As shown in the drawings for the purposes of illustration, the invention is embodied in a front loading, stackable, low height, ink-jet printer.

The apparatus offers a simple, inexpensive solution, easy self-evident operation, and leverages the datum structure from a print cartridge currently in production.

THE PRINTER

Referring to FIG. 1, reference numeral 114 generally indicates an ink-jet printer partially cut away and with its front loading door removed. The printer includes a case part 115 and a DC drive motor 116 mounted on a chassis. Mounted on the shaft of the motor 116 is a pulley 117 that drives a belt 118 back and forth as the drive motor reverses in direction. The drive belt 118 is attached to a carriage 119 that scans laterally back and forth from left to right and right to left. The carriage 119 contains two thermal ink-jet print cartridges 11, 11' located side by side. Print cartridge 11 contains black ink, and print cartridge 11' has three ink chambers containing magenta, yellow and cyan inks. The horizontal scanning motion of the carriage is guided by a slide rod 121. Located in the rear of the carriage 119 is an encoder, not shown, that reads an encoder strip 122 that enables the electronic circuits in the printer to locate the carriage 119 along its scanning path. After the printer 114 prints a sheet of media, the media is ejected into an output tray on which a handle 123 is mounted.

THE PRINT CARTRIDGE

Referring to FIGS. 2–8, reference numeral 11 generally indicates a low profile ink-jet print cartridge for a printer. The low profile cartridge 11 of the present invention allows printer 114 to be relatively shorter and narrower than its predecessors while still retaining a relatively high ink containing capacity in cartridge 11. Cartridge 11 and printer 114 are together adapted to allow for a horizontal loading of the cartridge 11. This allows electronics and other items to be stacked on top of printer 114 even when cartridge 11 is being replaced. Enabling stackable and shorter printing systems allows such printing systems to enter new applications such as home printing appliances that have critical stackability and space constraints .

In a particularly preferred embodiment of the invention, the print cartridge is about forty-seven millimeters (47 mm) high, the printer is less than four inches (4") tall, and the cartridge contains at least seventeen cubic centimeters (17 cc) of ink.

The print cartridge includes a print cartridge body 12 that is generally rectangular and prismatic in shape with a front wall 24, a left side wall 25, a right side wall 26, and a back wall 27. The walls 25, 26 are spaced apart horizontally and extend both horizontally and vertically. Front wall 24 and back wall 27 are also spaced apart horizontally and extend both horizontally and vertically. The low profile body 12 has three orthogonal axes the orientation of which relative to the vertical and horizontal directions is further explained below, and which are defined by the walls, including a major axis or an axis of elongation (depth) between the front and back walls 24, 27. This elongate dimension allows the cartridge to house more ink while not impacting the printing system height (affected by the height of the cartridge) or the system width (affected by the spacing between the left and right side walls).

Figure 2:
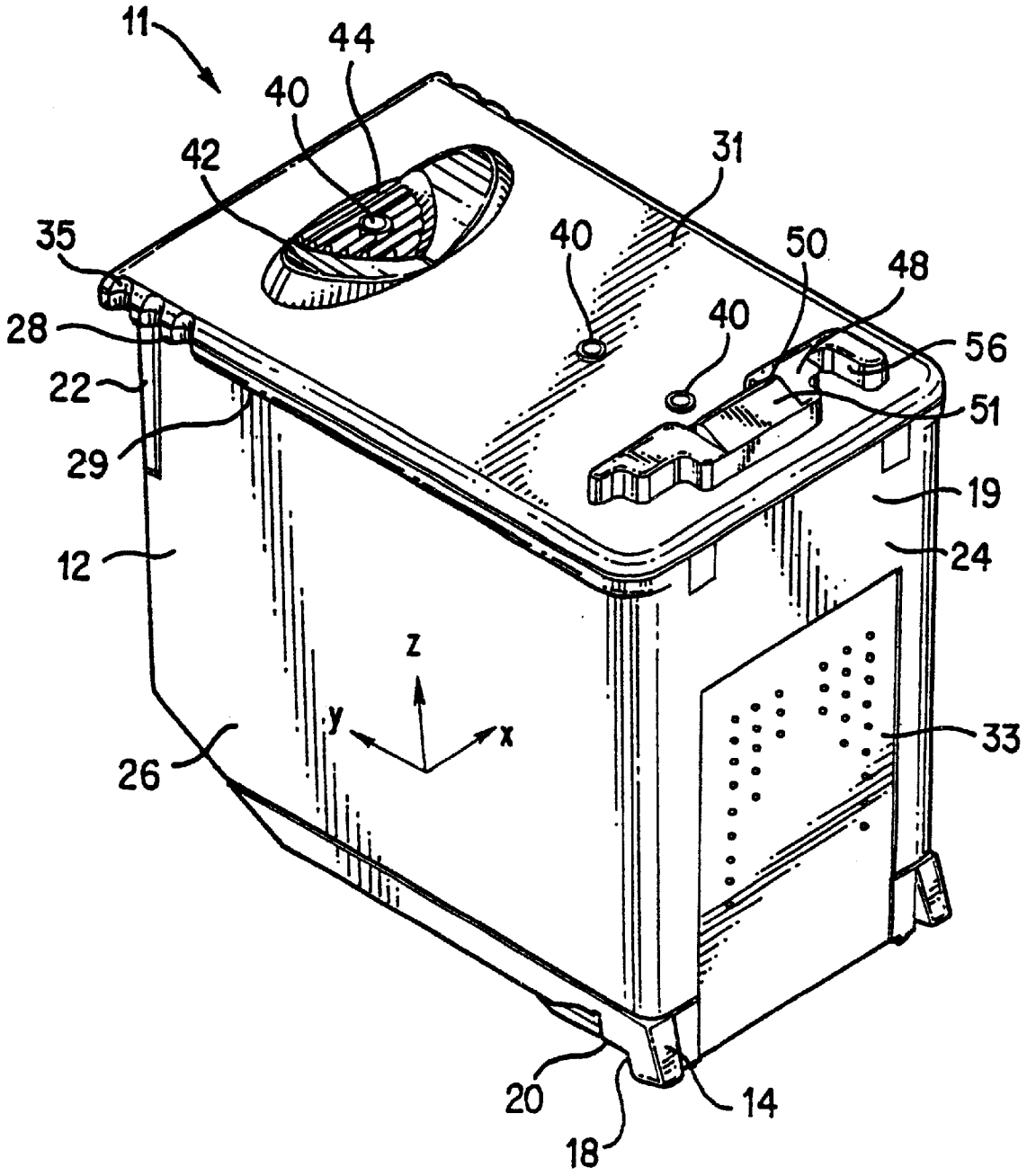
FIG. 2 is a perspective view, of the inkjet print cartridge of FIG. 1.

The cartridge 11 has a back wall portion, generally indicated by reference numeral 28, viewing FIG. 2, which back wall portion 28 includes a "user portion," or "user features," including a back wall 27 (best seen in FIGS. 3 and 4), and which user features are particularly configured for a user to manually grasp, contact, and push against as is convenient, desirable, and necessary during installation of the cartridge 11 into a printer. The "user portion" or "user features" particularly include user-friendly ergonomic features (such as gripping features 35) which are discussed in greater detail below.

Figure 5:
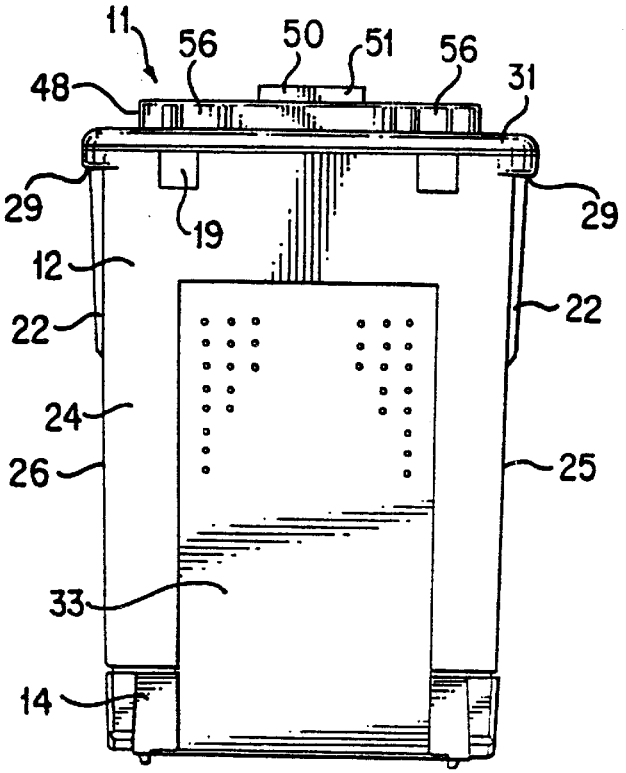
FIG. 5 is a front side elevational view of the print cartridge of FIG. 2.
Figure 7:
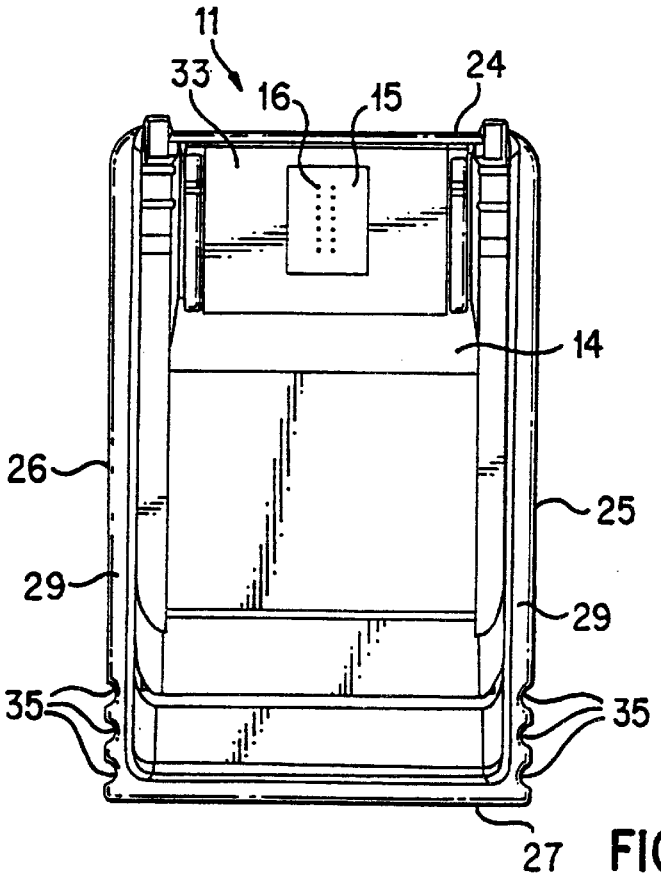
FIG. 7 is a bottom plan view of the print cartridge of FIG. 2.

Cartridge 11 includes an electrical connection or front portion 30, FIGS. 2, 5, and 7 including front wall 24 that includes a plurality of electrical contacts disposed upon a circuit 33 for conducting electrical signals from the printing system for energizing the cartridge 11. These contacts are preferably located as far from the user portion 28 as possible to prevent a user from contaminating the contacts on circuit 33 with, for example, fingerprints. Having the axis of elongation between the front and back walls enhances this aspect.

Cartridge 11 includes a top wall 31 positioned in connecting relationship between the back wall 27 and the front wall 24. In a preferred embodiment, the top wall 31 is a lid 31. The top wall 31 joins the side, front, and back walls along side, front, and back margins, respectively. Included on the top wall is a latch feature 50 that is spaced away from the front margin.

In one embodiment, the print cartridge body houses three ink chambers for holding inks of the various hues, black, cyan, magenta, and yellow. The ink chambers are filled with reticulated polyurethane foam. The foam is compressed to maintain the back pressure of the ink at the print head 15, FIG. 7. In the bottom of each chamber is a stand pipe and filter of conventional construction to insure that particles do not clog the nozzles. A second embodiment of print cartridge 11 houses a single chamber for carrying black ink.

Figure 3:
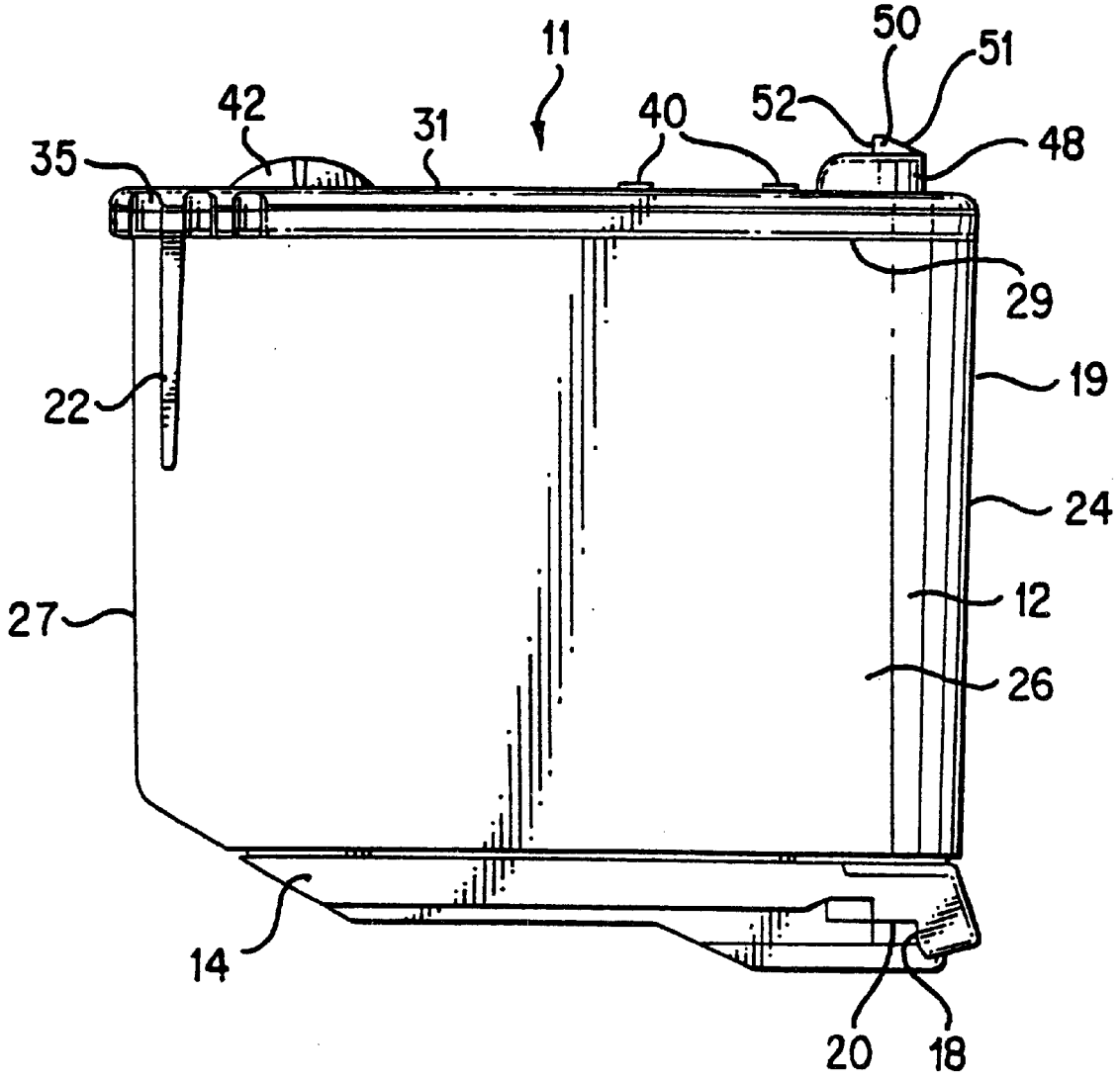
FIG. 3 is a right side elevational view of the print cartridge of FIG. 2.
Figure 4:
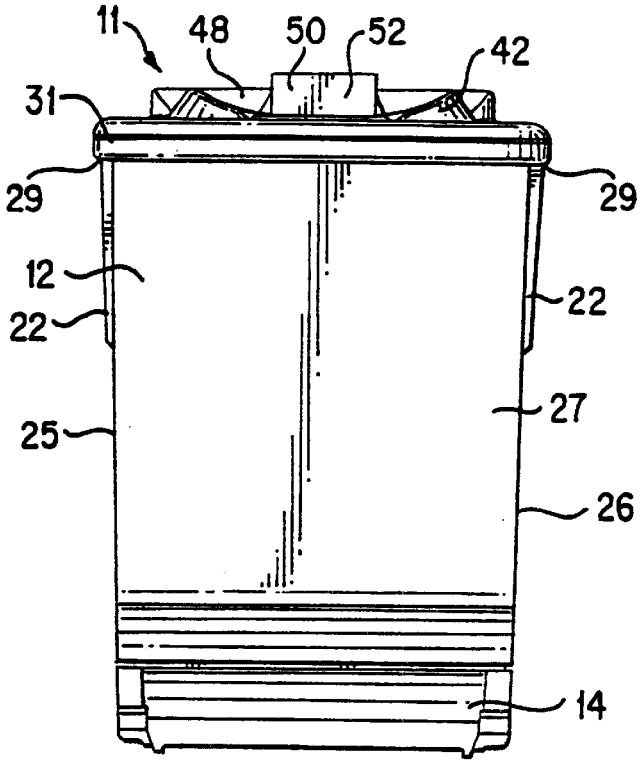
FIG. 4 is a back side elevational view of the print cartridge of FIG. 2.
Figure 6:
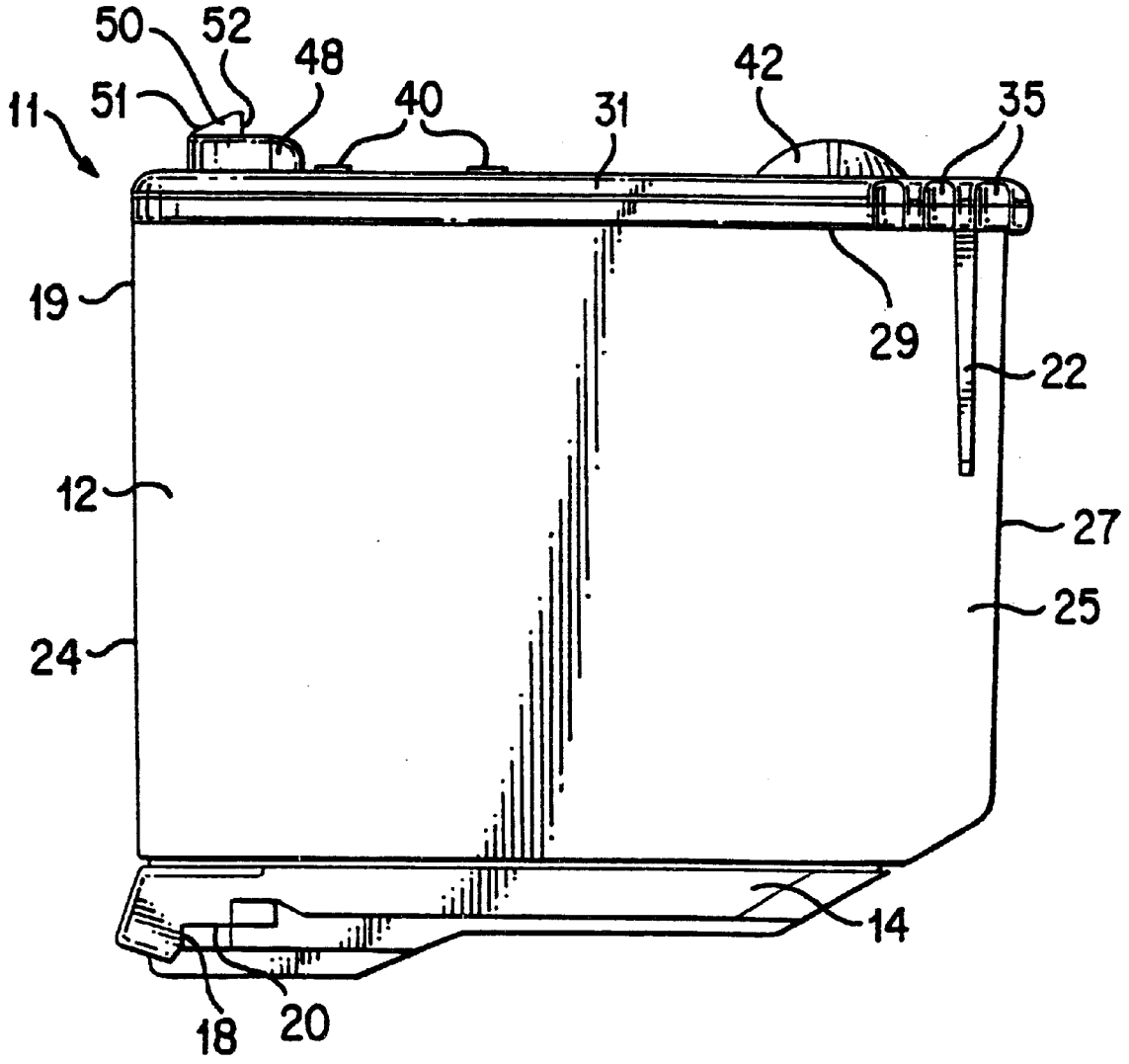
FIG. 6 is a left side elevational view of the print cartridge of FIG. 2.

The print cartridge body 12 also includes a nose piece 14 that is ultrasonically welded to the body. It will be noted that the nose piece 14 provides a lower wall for the cartridge body 12. The top wall 31 and lower wall 14 are spaced apart vertically and extend horizontally. Because the print head 15 needs to extend generally in a horizontal plane so that during operation of the printer 114 the nozzles 16 can eject droplets of ink generally vertically downwardly onto print media in a printing zone disposed below the cartridges 11, 11' (recalling FIG. 1), the orientation of the print head 15 establishes directions for the X, Y, and Z axes relative to the vertical and horizontal directions (recalling FIG. 2). The nose piece contains three channels that each connect to a stand pipe in one of the ink chambers. The channels direct the ink from the chambers to one of three series of nozzles 16, FIG. 7, on the print head 15. Located on the nose piece 14, FIGS. 3 and 6, are an X axis datum 18 and an Z axis datum 20. These datums are holding points and are adapted from a print cartridge currently in production. The Y axis datum 19, FIG. 2, is provided by the front wall 24 of the print cartridge and is a stop point for the cartridge during insertion into carriage 119. The X and Z datums 18, 20 mate with corresponding datums 152, 154, FIGS. 12 and 13 on the carriage 119, FIG. 9, and align the print cartridge 11 in the carriage, as explained in detail below.

Referring to FIGS. 2, 3, and 6, reference numeral 22 generally indicates two ribs that serve as gripping surfaces when the print cartridge 11 is removed from the printer. Each rib is located vertically on one of the side walls 25, 26, along the common margins between the side walls 25 and 26 and the back wall 27 of the print cartridge body 12.

Referring to FIGS. 2, 3, 4, 5, and 6, reference numeral 29 generally indicates an elongate supporting lip located on the two side walls 25, 26 and the back wall 27 of the print cartridge body 12. The lip is located along the margin between the print cartridge body 12 and the lid 31, described in detail below. The portions of the lip 29 located on the side walls 25, 26, FIGS. 4 and 5, support and guide the print cartridge during loading and unloading from a printer. These portions of the lip engage a pair of corresponding guide rails 140, FIGS. 10, 12, and 13, or loading ramps on the carriage 119 of the printer.

Also located on the print cartridge body 12, FIGS. 2 and 5, is a flex circuit 33 of conventional construction. The flex circuit provides the electrical interconnection between the printer and the print head 15, FIG. 7, and routes electrical energy to the appropriate firing resistors during printing.

Figure 8:
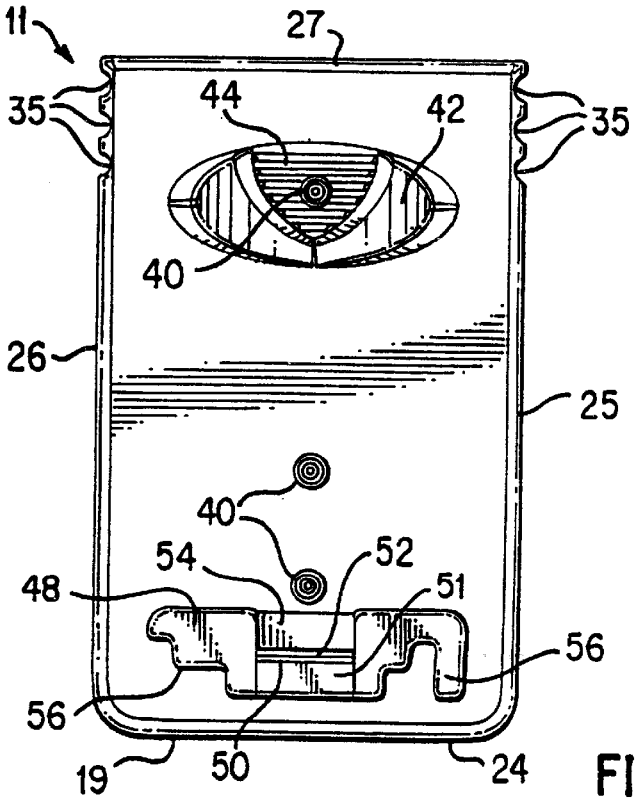
FIG. 8 is a top plan view of the print cartridge of FIG. 2.

Referring to FIGS. 2 and 8, reference numeral 35 indicates a plurality of gripping grooves located along the margin between the lid 31, described in detail below, and the side walls 25, 26 of the print cartridge body 12. The grooves of feature 35 are cooperatively defined by the ribs 22 described above. The gripping grooves serve as a gripping surface on the print cartridge 11 from removing the print cartridge from a printer once the print cartridge has been unlatched from the carriage. The gripping grooves also serve as a visual indication with respect to any adjacent print cartridges that the associated print cartridge has been unlatched from the carriage.

Referring to FIGS. 2, 3, 4, 5, and 6, reference numeral 31 generally indicates a lid having a planer outside surface. The plane of the outside surface of the lid is also parallel to the supporting lip 29. The lid 31 is ultrasonically welded to the print cartridge body 12 along the margin of the side walls 25 and 26, the front wall 24, and the back wall 27. The lid seals the ink in the ink reservoir chambers within the print cartridge body 12. The lid also contains three vents 40, FIGS. 2 and 8 that allow air at atmospheric pressure to enter each of the reservoir chambers.

Located on the lid 31, FIGS. 2 and 8, proximate to the margin between the back wall 27 and the lid is a button-like structure 42. In the top plan view of the print cartridge 11, FIG. 8, this structure has an elliptical shape. In the back side elevational view, FIG. 4, this structure has an outward opening, circular shape. In the side elevational views, FIGS. 3 and 6, this structure has the shape of a chord of a circle. The middle of this structure is flush with the outside surface of the lid 31 and contains a plurality of groove 44. The groove act as a gripping surface for the user. This structure has this unique shape to indicate to the user where to push the print cartridge down to unlatch the cartridge from the carriage of a printer. Such downward motion releases the print cartridge from the latch spring 148, FIG. 11, on the carriage 119, FIG. 9.

Referring to FIGS. 2 and 8, reference numeral 48 generally indicates an island located on the top surface of the lid 31 and displaced away from the margin between the lid 31 and the front wall 24 of the print cartridge body 12. The island 48 includes a latch 50 for securing the print cartridge 11 within a printer carriage. Referring to FIGS. 2, 3, and 6, the latch 50 is located on the lid 31 and not on the front wall 24 so that the print cartridge can be manufactured with existing equipment and without requiring new tooling. As illustrated in FIGS. 2, 3, and 6, the latch has a triangular cross section formed by a latch ramp 51 and a latch wall 52. The latch ramp 51 has three functions: to gradually increase the installing or latching force that must be exerted by the user when installing the print cartridge 11 in a printer; to ease the opening of the latch spring during installation; and to continuously force the print cartridge 11 out of the printer until the print cartridge is precisely seated in the carriage. This latter feature prevents "false latching" of the print cartridge. The latch wall 52 is located perpendicular to the outside surface of the lid 31 and is the surface engaged by the latch spring when the print cartridge is precisely seated in the carriage of the printer.

The island 48, FIG. 8, further includes a latch well 54 located behind the latch wall 52. The latch well is a relieved area in the lid 31 that permits the latch spring 148, FIG. 11, to engage the latch wall 52 as necessary to maintain a constant latching force during the life of the printer. The island 48 also has two sets of keys 56 located on either side of the latch 50 that identify the print cartridge 11 to the printer.

While the print cartridge described above contains three ink reservoirs and three vents 40, FIGS. 2 and 8, it is contemplated that a print cartridge with one or more reservoirs with one or more vents can also be used. In the printer 114, FIG. 1, that is planned for this print cartridge, one print cartridge 11 having one reservoir containing only black ink will be installed adjacent to a second print cartridge 11' having three reservoirs containing the three primary hues.

Further, it is contemplated that a print cartridge can be used that does not require a lid 31 as described above. Such a cartridge would need only a top wall with the appropriate vent(s) that seals the one or more reservoirs.

THE CARRIAGE

Figure 9:
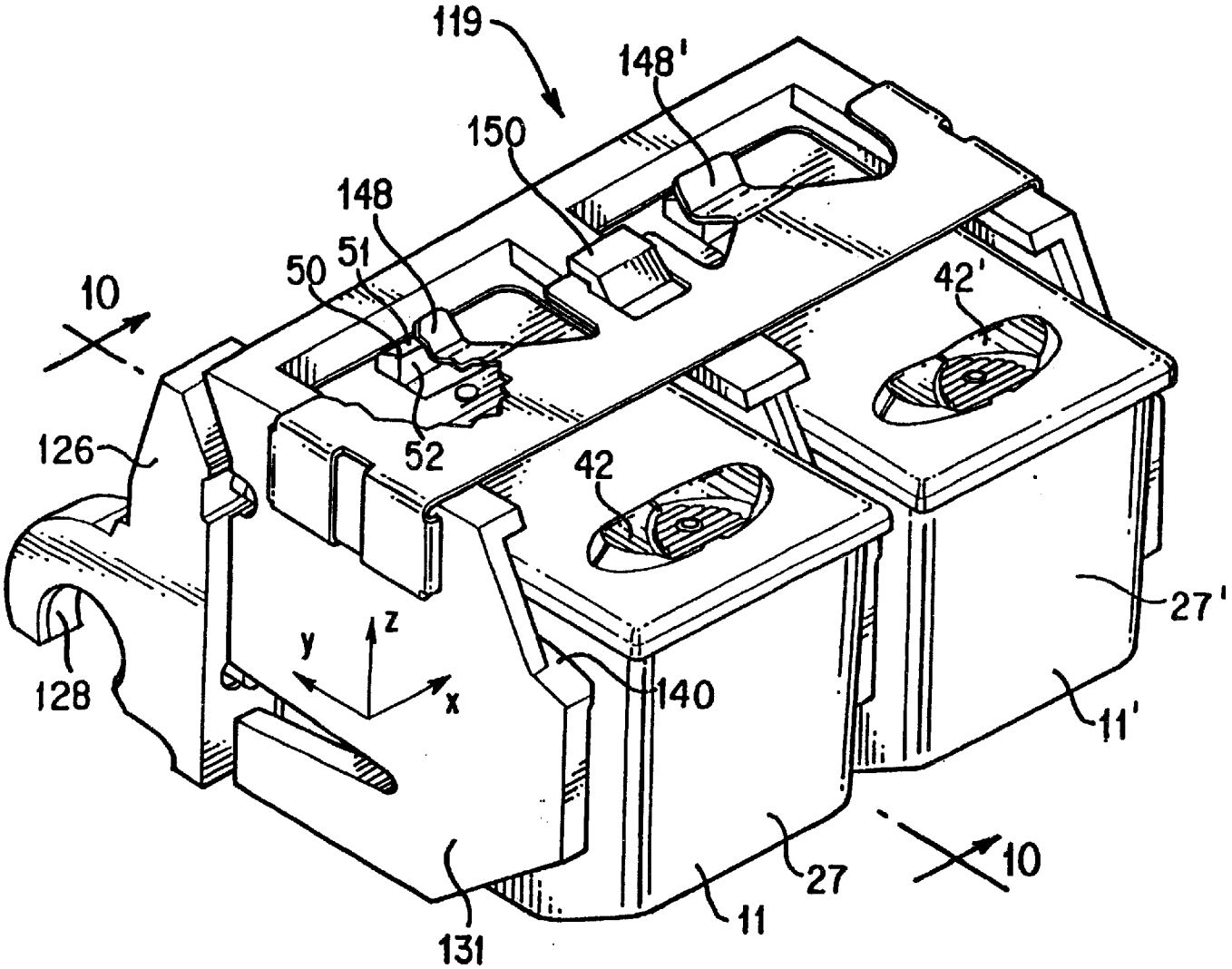
FIG. 9 is a perspective view, in section and partially cut away of the carriage and the ink-jet print cartridges of the ink-jet printer of FIG. 1.

In FIG. 9, the "X" axis is parallel with the longitudinal axis of the slide rod 121, FIG. 1. The "Y" axis is pointed to the rear and into the printer 114, FIG. 1, and is in the reverse direction to the path of the paper through the print zone. The "Z" axis is pointing vertically upward.

Figure 14:
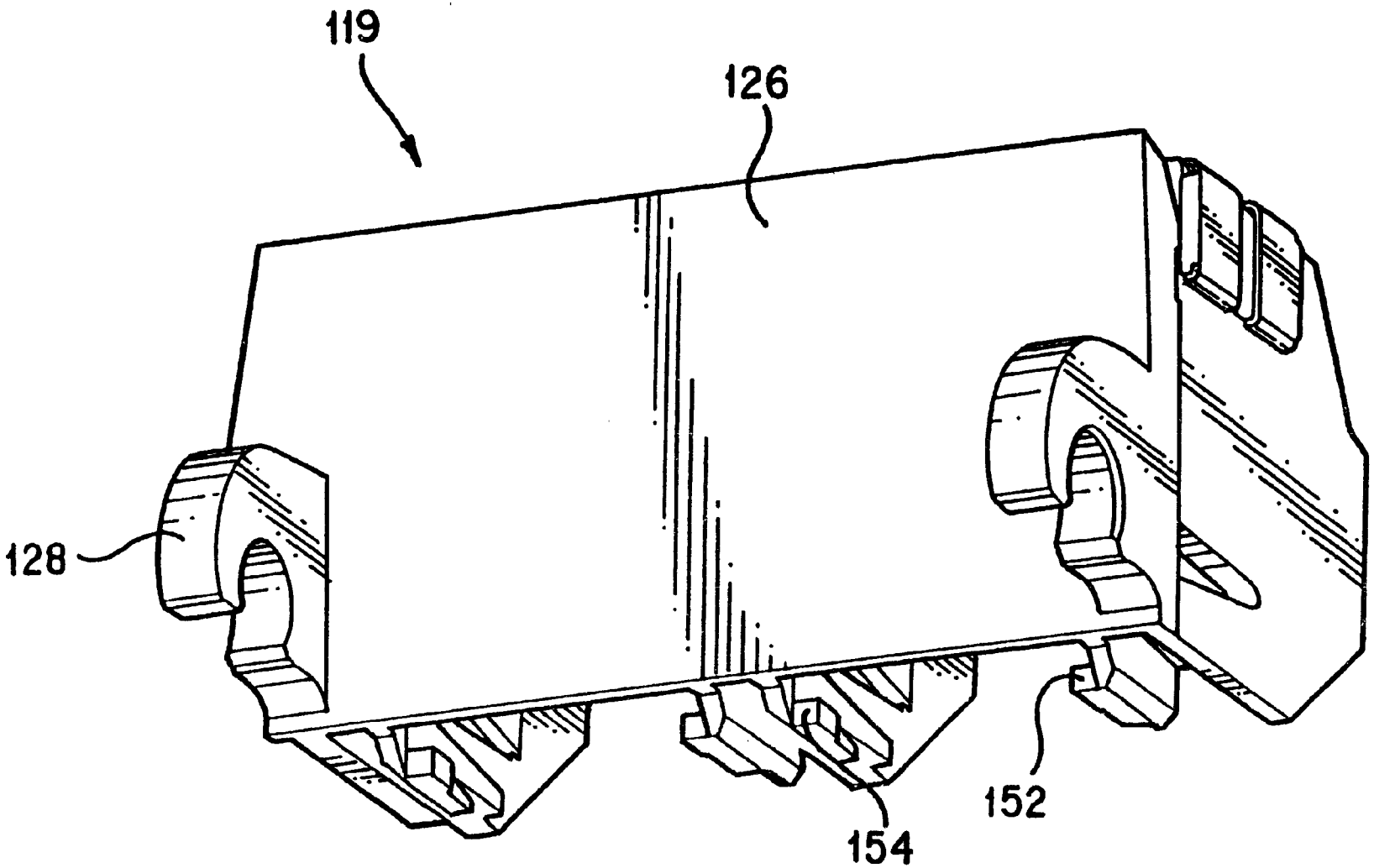
FIG. 14 is a rear perspective view of the carriage of FIG. 9, with the print cartridges removed.

Referring now particularly to FIGS. 9 and 14, the carriage 119 includes a carriage base 126 that supports the structure. The carriage base has two "C" shaped arch supports 128 located at its ends. These arch supports provide bearing support and engage the slide rod 121, FIG. 1.

Figure 12:
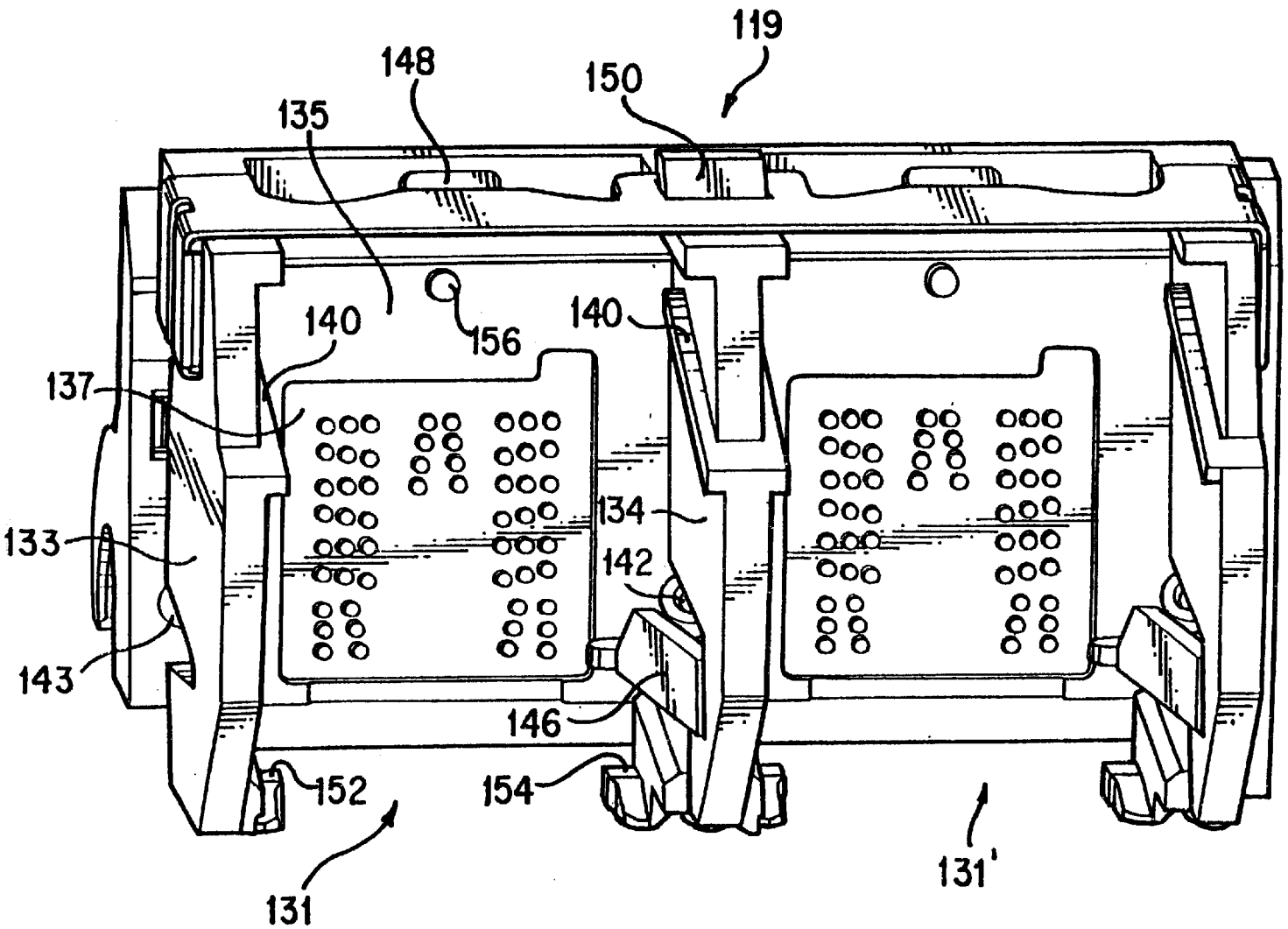
FIG. 12 and 13 are front perspective views of the carriage of FIG. 9, with the print cartridges removed.
Figure 13:
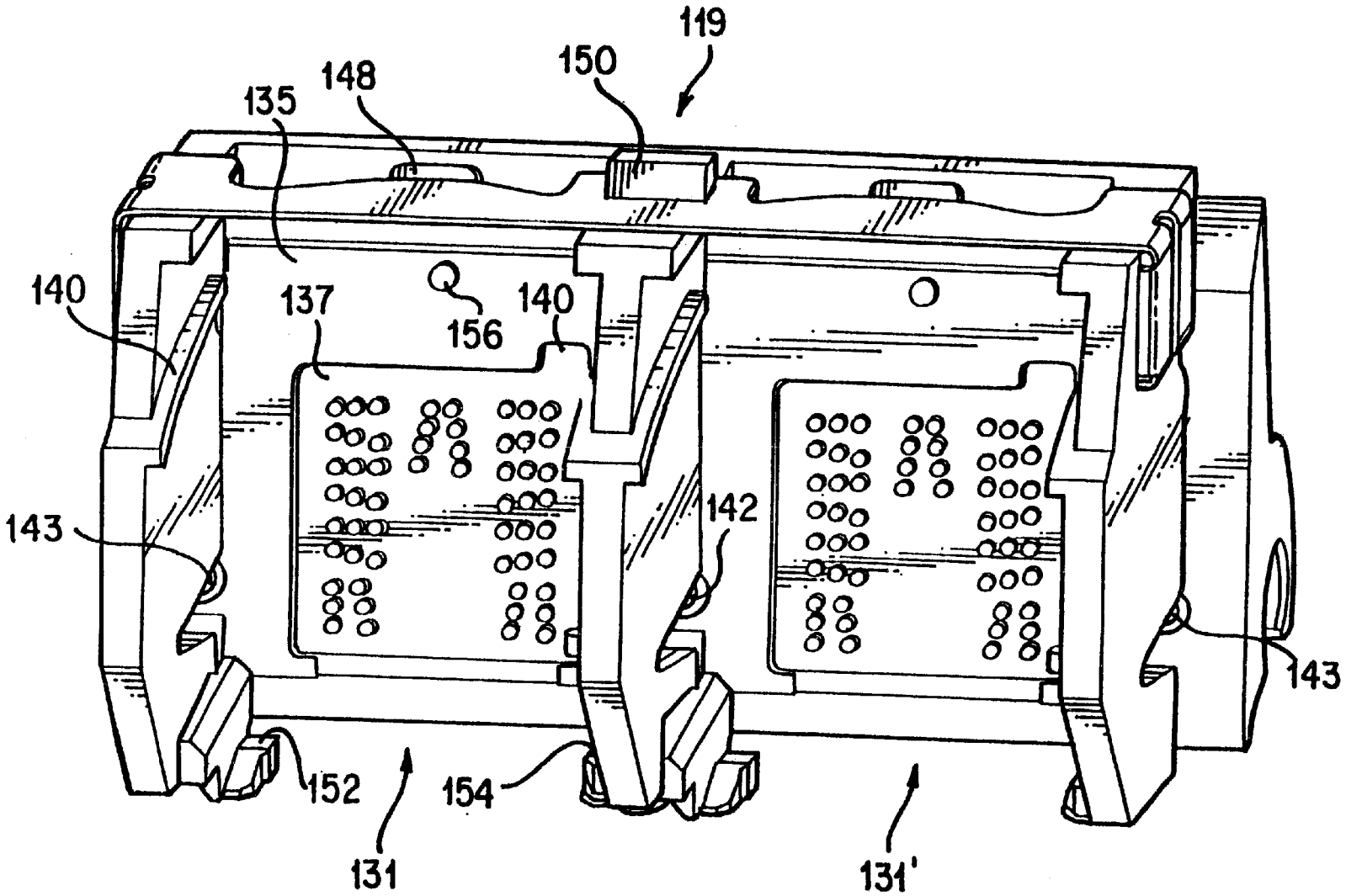

Referring to FIGS. 9, 12, and 13, the carriage 119 also includes two chutes 131 that each receive, hold, and align the ink-jet print cartridge 11 as illustrated in FIG. 9. Both chutes are constructed and operate in the same manner; so for brevity only the left chute will be described. The chute 131 has a left side wall 133, a right side wall 134, and a rear or end wall 135. Located on the rear wall 135 of the chute is a dimpled contact pad 137. The contact pad has an elastomeric backing and contains electrical contacts that are urged against corresponding contacts on the flex circuit 33, FIG. 2, on the print cartridge 11. In this manner the printer 114 makes electrical contact with the print cartridge and supplies electrical energy to the firing resistors during printing.

Dimpled contact pads for thermal ink-jet print cartridges and carriages are disclosed in U.S. Pat. No. 4,706,097 entitled "Near-Linear Spring Connect Structure for Flexible Interconnect Circuits" by Harmon issued Nov. 10, 1987.

Figure 10:
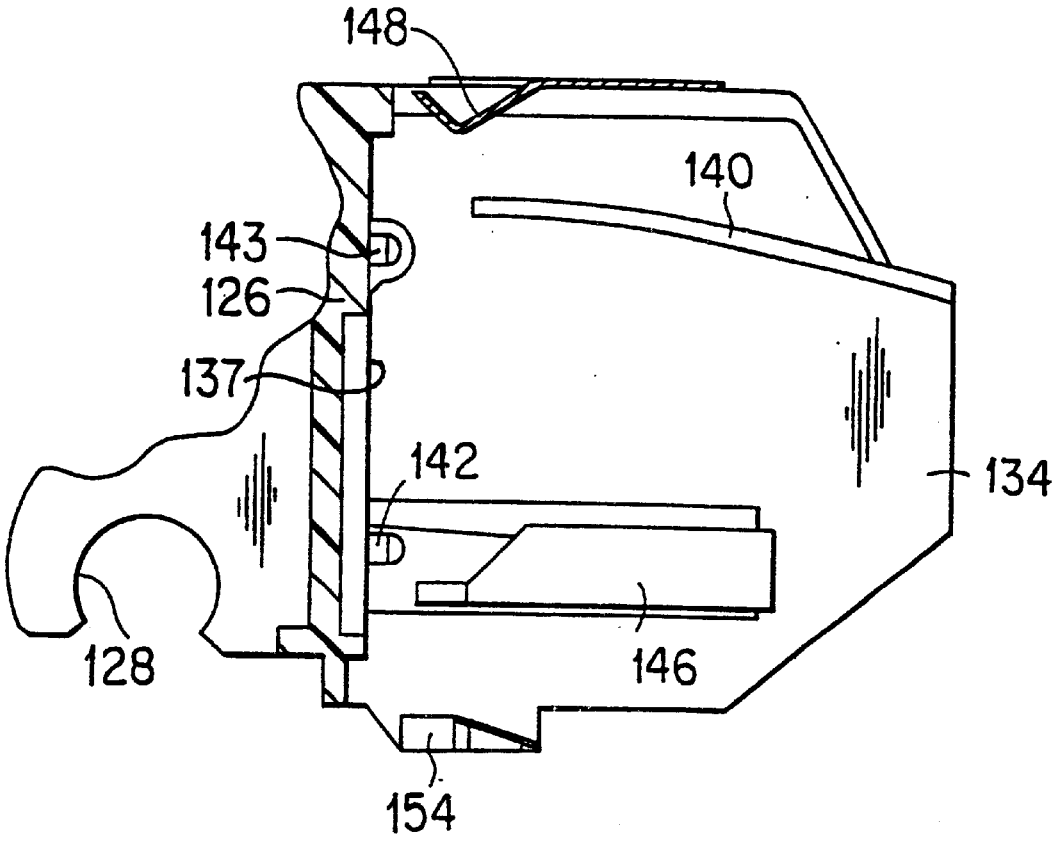
FIG. 10 is a side elevational view, in section, taken along line 10—10 of the carriage of FIG. 9, with the print cartridges removed.

The dimpled contact pads 137, FIGS. 10, 12, and 13, are held in place against the rear wall 135 of each chute 131 by six pins 142, 143 located on the carriage base 126. Pin 142 locates the dimpled contact pad left and right and vertically in the carriage 119. The other five pins prevent the contact pad from rotating about the center p in 142 and inducing any stress in the contact pad.

Referring to FIGS. 10, 12, and 13, located on each side wall 133, 134, of the chute 131 is a guide rail 140. The guide rails are the guiding feature for installing and removing print cartridges from the printer 114. Referring to FIG. 10, in particular, each guide rail is generally horizontal, curved, arcuate, and inclined slightly upward in the positive "Y" direction as illustrated in FIG. 9. The guide rails 140 engage the bottom of the lips 29, FIGS. 2 and 3, located on the sidewalls 25, 26 of the print cartridge 11, FIG. 2.

Further, the guide rails 140 in the chutes 131, FIGS. 12 and 13 serve many functions. First, the rails act as a target for the user when initially installing a print cartridge. They aid in locating the print cartridge 11 in the carriage 119, FIG. 1 which is only partially visible to the user. That is, viewing FIG. 1 again, it is seen that the cartridges 11, and 11' are disposed vertically between two horizontally extending planes (indicated with the dashed lines and reference characters P1 and P2). The lower horizontal plane P1 is located below the cartridges 11 and 11' at the level of the print media passing below these cartridges in a printing zone of the printer 114. The upper plane P2 is located at the level of the upper inner extent of the case 115. Because the print cartridges 11 and 11' are substantially recessed within the case, viewing FIG. 1, it is to be understood that the cartridges 11 and 11' necessarily have a low profile (i.e., are elongated in the horizontal direction from front to back), and must be inserted into and withdrawn from the carriage chutes 131 by movements that are essentially only horizontal and so that the cartridges 11 and 11' are maintained between the planes P1 and P2.

Figure 20:
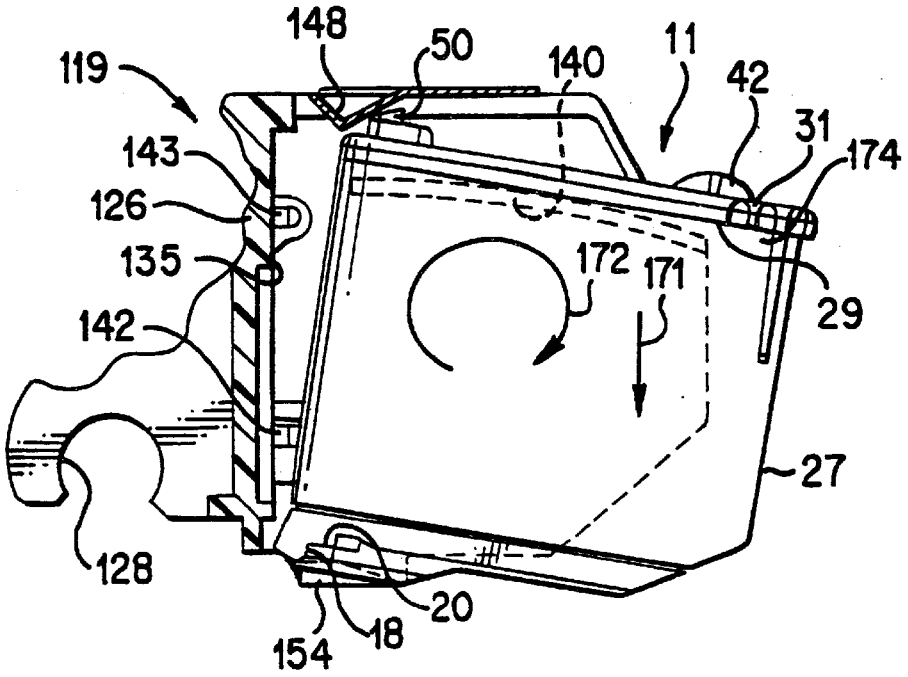

Second, once the print cartridge is resting on the guide rails and the print cartridge is pushed horizontally forward by the user, the rails guide the print cartridge up and over the primary and secondary carriage datums 152, 154, FIGS. 12, 13, and 14, described in detail below. Third, when a print cartridge is being unlatched from the carriage by the user, the guide rails limit the rotation or pitching of the print cartridge as illustrated in FIG. 20 so that it does not come tumbling forwardly and downwardly out of the printer 114.

Referring to FIGS. 10 and 12, located in the right side wall 134 of each chute 131 is a cantilever spring 146. The spring 146 h as a major axis that is horizontal. The cantilever spring biases or urges the print cartridge horizontally in the negative "X" direction as illustrated in FIG. 9, against the primary datums 152, FIGS. 13 and 14, on the carriage as described in detail below.

Figure 11:
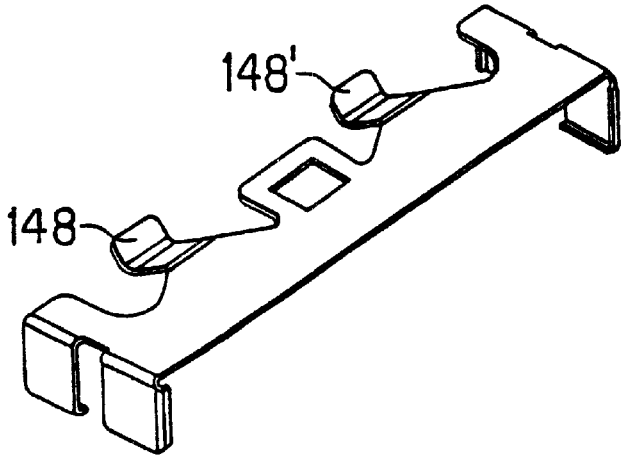
FIG. 11 is a perspective view of the latch spring of the carriage of FIG. 9.

In FIGS. 9, 10, 11, 12, and 13, reference numeral 148 indicates a latch spring having a horizontal tab pointing rearward in an ink-jet printer 114, FIG. 1, along the "Y" axis as illustrated in FIG. 9. The spring is directed in this manner to achieve the design objective of low printer height. The latch spring engages a latch 50, FIG. 2, molded into the lid 31 of the print cartridge as illustrated in FIG. 9. There is a latch spring for each chute 131, and they are fabricated from a single sheet metal part as illustrated in FIG. 11. The part is attached to features molded in the outside walls of the chutes 131. The part is also attached to an arresting finger 150 located on the center side wall of the carriage 119. The arresting finger has the shape of an "L" and prevents the mechanical strain from installing a print cartridge in one chute from affecting the print cartridge in the chute along side.

Referring to FIGS. 12, 13, and 14, located on the inside of the left side wall 133 at the bottom of the chute 131 are the primary datums 152 of the carriage 119. The corresponding datums 18, 20 on the print cartridge illustrated in FIG. 6 are urged against the primary datums 152 in the chute by the cantilever spring 152 in the right side wall 134 of the chute 131. Located on the inside of the right side wall 134 at the bottom of the chute 131 and directly opposite the primary datums 152 are the secondary datums 154 of the carriage 119. The secondary datums 154, FIGS. 12 and 14 engage the corresponding datums 18, 20 on the print cartridge illustrated in FIG. 3. There is a single tertiary datum 156 located in the rear wall 135 of the chute 131 above the dimpled contact pad 137. The tertiary datum locates the rotation or pitching of the print cartridge about the "X" axis to a known point.

OVERALL DISCUSSION—CARRIAGE AND PRINT CARTRIDGE INTERFACE

Referring to the figures, with particular reference to FIGS. 15–21, the print cartridge 11 has a low profile body with mechanical interfacing features that enable installation of cartridge 11 into a receiving pocket or chute of a printing system carriage with a predominately horizontal motion.

The low profile aspect of the print cartridge body refers to the body having a major axis essentially aligned with the direction of installation 158 (or along the y-axis of FIG. 9). This allows the overall height (along z-axis of FIG. 9) of the print cartridge body to be minimized, thereby minimizing the overall height of the carriage 119 and hence printer 114. In particular, the height of the print cartridge is kept to less than about 47 millimeters. The low profile aspect also helps to minimize the width (along x-axis of FIG. 9) of the carriage 119 which reduces width of the overall printer 114 (recalling the explanation above about planes P1 and P2 constraining installation and removal motions of the print cartridges 11 and 11' essentially to only horizontal motion between these planes).

Figure 15:
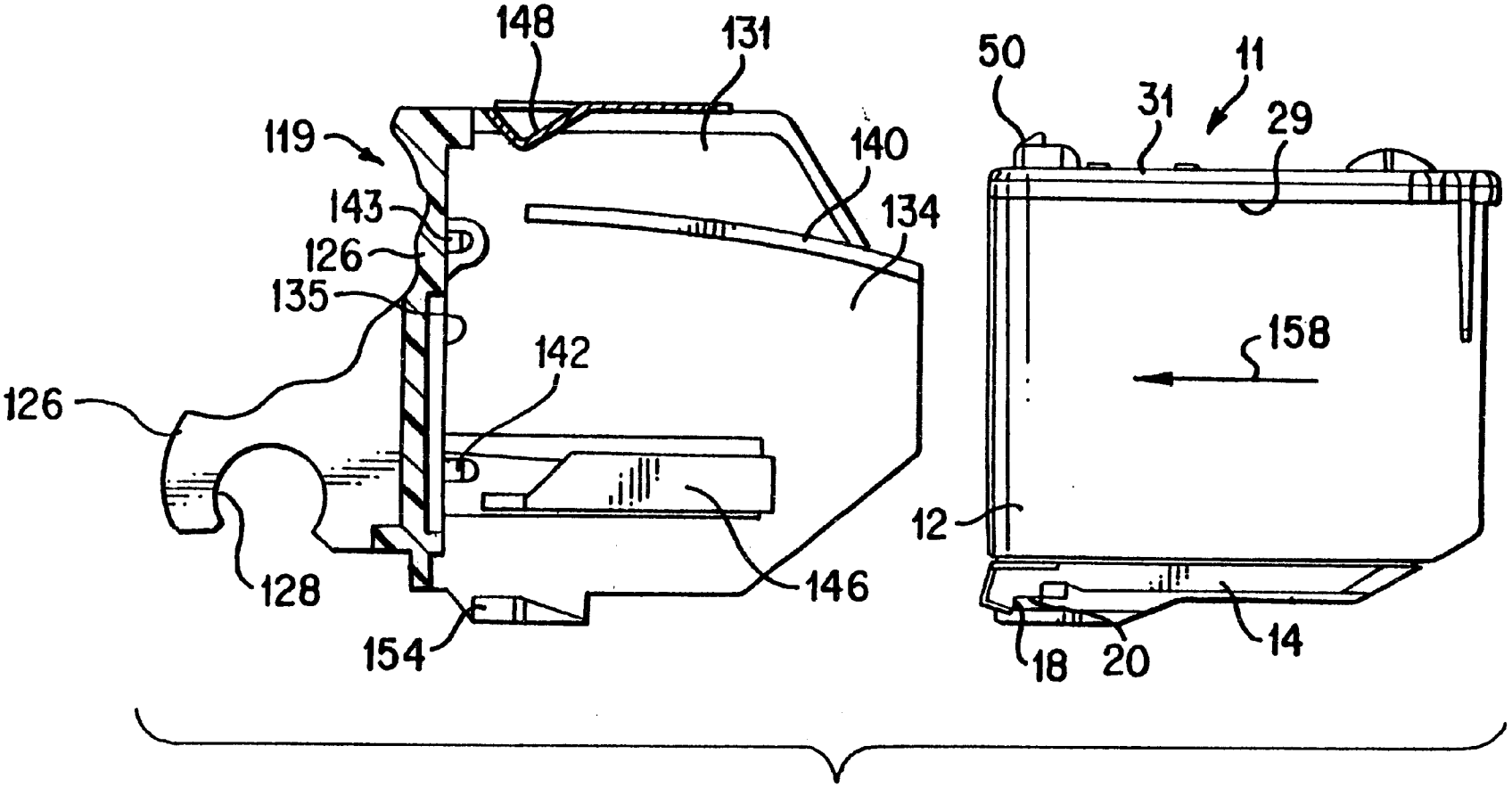
FIGS. 15–21, inclusive, are side elevational views, in section and partially cut away, taken along line 10—10 of the carriage of FIG. 9, illustrating the sequence of horizontally loading and unloading the ink-jet print cartridge of FIG. 2 from the carriage.

The mechanical interfacing features enable the print cartridge to be installed into chutes or receiving pockets 131 along a direction indicated by reference numeral 158 of FIG. 15. This enables "stackability" of printer 114—it allows other devices such as complementary electronic devices to be placed on top of printer 114. This in turn allows printing system 114 to be used in many more consumer applications than conventional printers or printing systems. The mechanical features include latch 50, datums 18 and 20, lips 29, and/or other features that engage corresponding features in receiving chutes 131. More details of the mechanical interfacing features will be discussed below in the sections titled "horizontal loading" and "unloading".

HORIZONTAL LOADING

Referring to FIG. 15, to load a print cartridge 11 in a carriage 119, the end user translates the print cartridge horizontally forward toward the carriage as indicated by the motion arrow 158. The guide rails 140 as illustrated in FIGS. 12 and 13 act as targets for the end user because visibility of the carriage is restricted by the housing for the printer.

Figure 16:
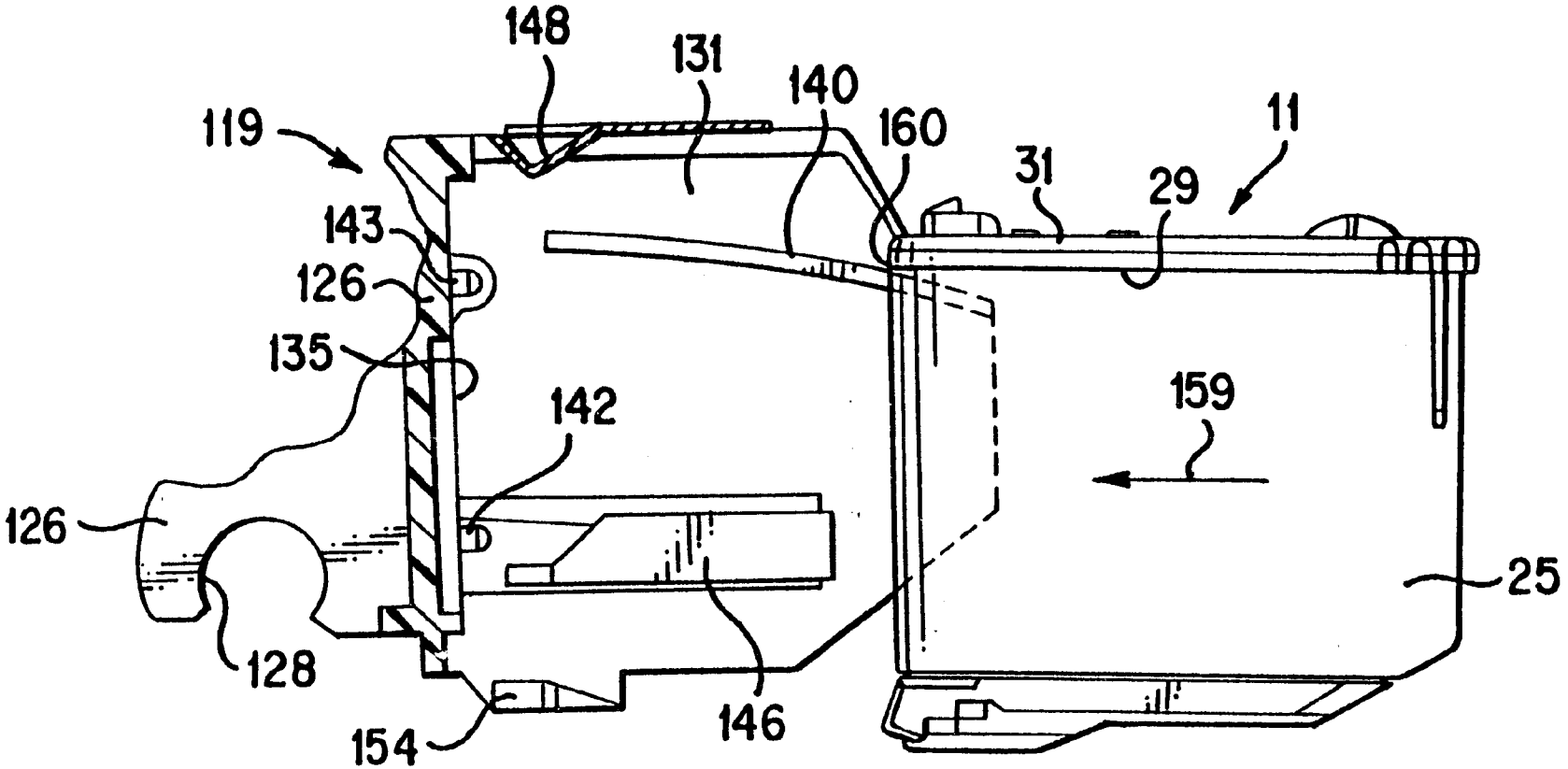

The print cartridge 11, FIG. 16 has a lip 29 projecting laterally outwardly from each of its side walls 25, 26. The underside of these lips first touch the guide rails 140 at the contact point 160, FIG. 16. The lips on each side are placed on the guide rails of the chute 131 by the end user and the guide rails thereafter support the cartridge vertically. At this point there is no contact between the vertical walls of the carriage 119 and vertical walls of the cartridge 11. The end user continues to horizontally translate the cartridge forward as indicated by the confirmed motion arrow 159 (recalling arrow 150 of FIG. 15).

Referring to the print cartridge 11 illustrated in FIG. 9, any positive or right hand rotation of the print cartridge about the "X" axis is defined as "pitching up" in accordance with the normal nautical and aeronautical convention of describing motion of an object. Likewise, any negative or left hand rotation of the print cartridge about the "X" axis is defined as "pitching down".

Each guide rail 140, referring to FIG. 10 in particular, is generally horizontal, curved, arcuate, and inclined slightly upward in the positive "Y" direction as illustrated in FIG. 9.

Figure 17:
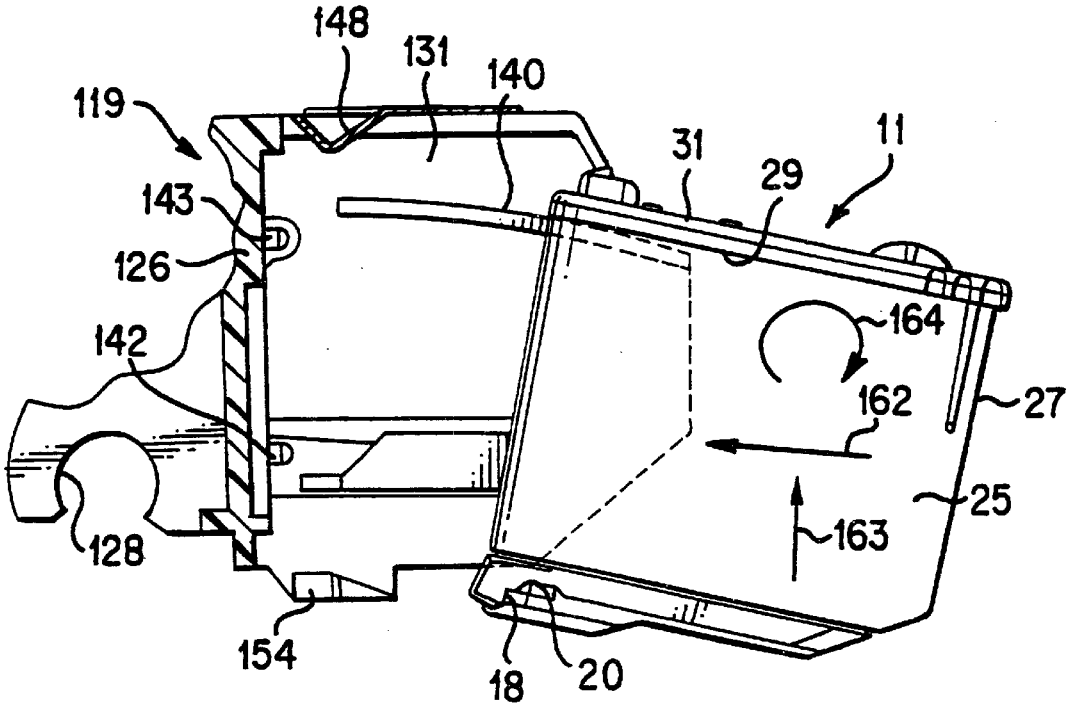

Referring to FIG. 17, the shape of the guide rails and the further horizontal translation of the print cartridge 11 by the end user indicated by the motion arrow 162 cause the print cartridge 11 to pitch up as indicated by the motion arrow 164 and also to translate vertically upward as indicated by the motion arrow 163. As the print cartridge 11 slides forward along the guide rails, the combination of these three motions, indicated by the motion arrows 162, 163, and 164, causes the datums 18, 20 on the print cartridge 11 to be brought up and over the primary and secondary datums 152, 154, on the bottom of the carriage 119.

The motion of the print cartridge 11 illustrated in FIG. 17 continues until the latch 50 on the top wall 31 of the print cartridge contacts the latch spring 148 on the carriage 119 at the contact point indicated by reference numeral 166. The latch spring causes the print cartridge to translate vertically downward as indicated by the motion arrow 168. Next the datums 18, 20 on the print cartridge 11 contact the primary and secondary datums 152, 154, on the carriage 119. At this point the datums are not yet seated, just in contact. The print cartridge 11 thereafter pitches downward as indicated by the motion arrow 167 due the contact between the datums and the shape of the latch 50 and latch spring 148.

Figure 18:
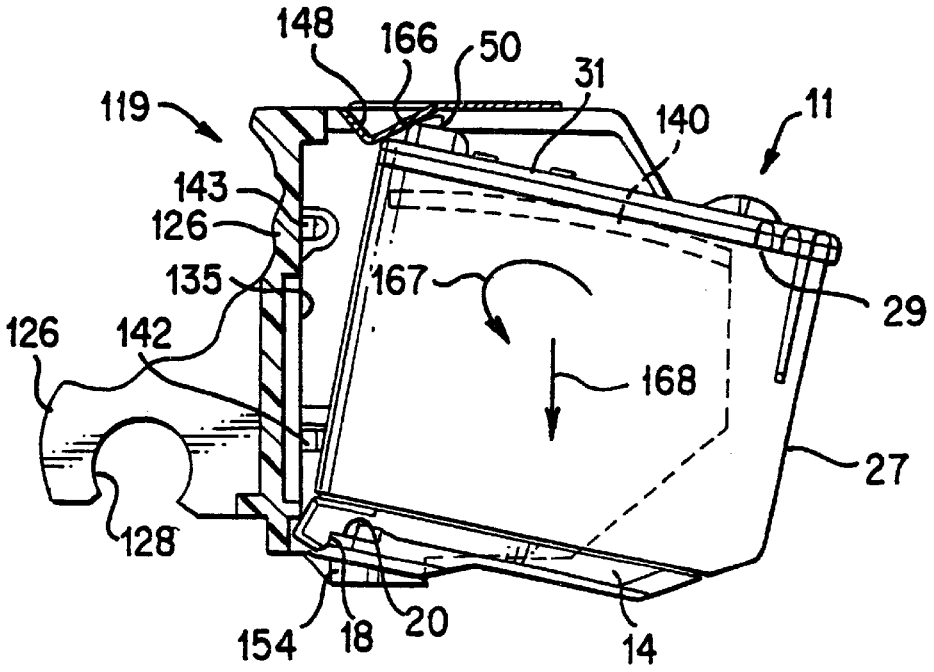
Figure 19:
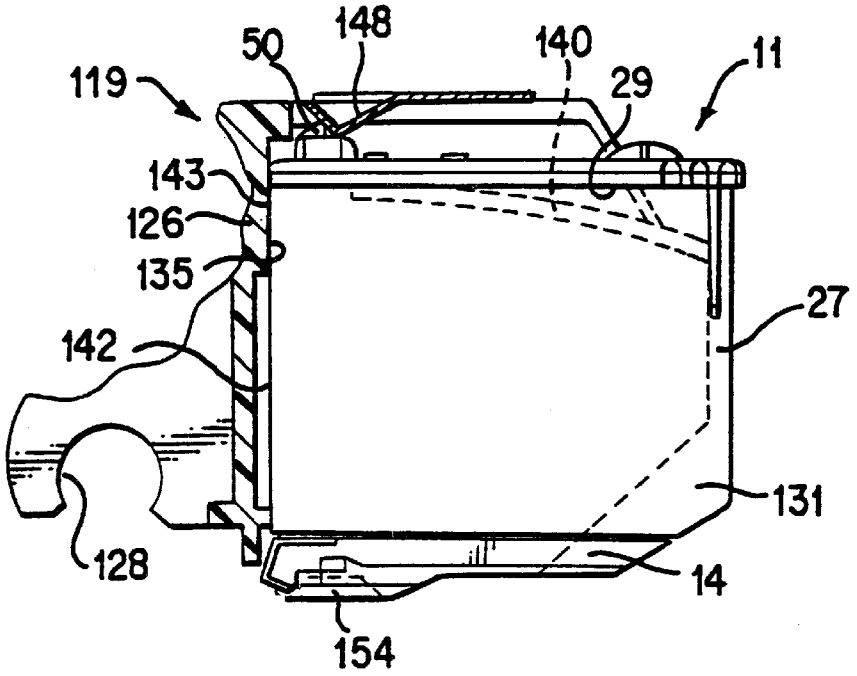

The motion of the print cartridge illustrated in FIG. 18 continues until the datums 18, 20 on the print cartridge 11 and the datums 152, 154, on the carriage 119 all snap into place, mating, and the latch spring 148 seats on the latch 50. Further downward pitching of the print cartridge is arrested by the rear wall 135 of the chute 131, the elastomer behind the dimpled contact pad 137, and the tertiary datum 156, FIG. 12. The print cartridge 11 is fully received in the carriage 119 at this point as illustrated in FIG. 19. It should be appreciated that the latch spring 148 continuously pushes the print cartridge out of the printer until this point of latching or mating is reached. This feature is binary and prevents false latching.

UNLOADING

Referring to FIG. 20, to unload a print cartridge 11 from a carriage 119, the end user applies a downward force to the top wall or lid 31 at the rear of the print cartridge. The print cartridge extends out from the carriage 119 as illustrated in FIG. 9, and this downward force may be applied to the button-like feature 42 on the lid. The downward force causes the downward motion indicated by the motion arrow 171, and the print cartridge pitches upward, as indicated by the motion arrow 172, as the datums 18, 20 on the print cartridge 11 pivot around the primary and secondary datums 152, 154 on the carriage 119. The downward motion indicated by the motion arrow 171 and the upward pitching motion indicated by the motion arrow 172 continue until the latch 50 unlatches from the latch spring 148, as illustrated in FIG. 20. The guide rails 140 engage the lips 29 on the print cartridge 11 and limit the upward pitching motion 172 so that the print cartridge does not rotate or pop out of the printer.

It should be appreciated from a comparison of FIGS. 9, 19 and 20, that when a print cartridge is unlatched, the upper rear corner 174 of the unlatched print cartridge protrudes beyond the back wall 27 of the adjacent, latched print cartridge. The unlatched cartridge sits cocked compared to the latched print cartridge. This feature provides a visual indication of unlatching to the end user and also provides a gripping surface to the end user.

Figure 21:
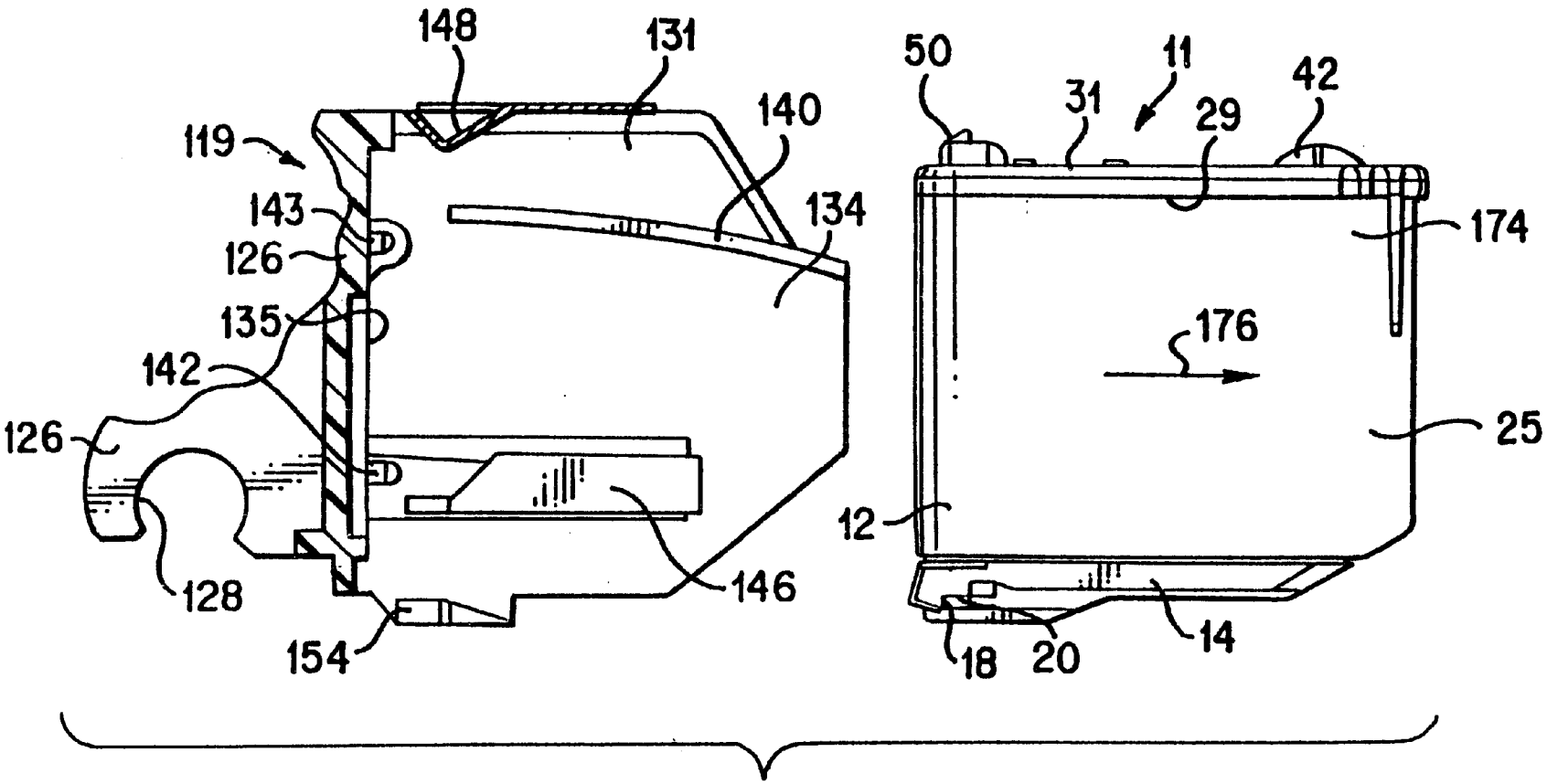

Referring to FIG. 21, after the print cartridge 119 is unlatched but still remains in the carriage 119, the end user grabs the gripping surface 174 and horizontally translates the print cartridge out of the carriage as indicated by the motion arrow 176.

Although specific embodiments of the invention have been described and illustrated, the invention is not to be limited to the specific forms or arrangement of parts so described and illustrated. The invention is limited only by the claims.

We claim:

1. Apparatus for horizontally loading a print cartridge into a carriage, comprising:

a) a generally rectangular print cartridge body having first and second side walls, a front wall, and a back wall;

b) a top wall having a planer outside surface, said top wall being affixed to the cartridge body;

c) an elongate supporting lip located on the first side wall of the cartridge body, said lip being parallel to the planer outside surface of the top wall;

d) a carriage body;

e) a chute mounted on the carriage body for receiving a print cartridge, said chute having first and second sidewalls and an end wall; and f) a generally horizontal rail on the first sidewall of the chute for engaging the supporting lip on the print cartridge and for guiding the print cartridge into the carriage.

2. The carriage of claim 1 wherein the horizontal rail is arcuate.

3. The carriage of claim 1 wherein the horizontal rail is inclined slightly upward.

4. The apparatus of claim 1 further including a second elongate supporting lip located on the second side wall of the cartridge body, said second lip likewise being parallel to the planer outside surface of the top wall and further including a second generally horizontal rail on the second side wall of the chute for engaging the second supporting lip on the print cartridge and guiding the print cartridge into the carriage.

5. The apparatus of claim 1 further including a latch located on the top wall of the print cartridge and a cantilever latch spring mounted on the carriage and having a generally horizontal tab so that when the print cartridge is fully received in the carriage, the latch is mechanically engaged by the latch spring.

6. The apparatus of claim 1 wherein the top wall has a planer outside surface and further including a latch ramp leading to a latch wall located perpendicular to the outside surface of the top wall.

7. A method of horizontally loading a print cartridge into a carriage, comprising the steps of:

a) translating a print cartridge horizontally forward into a carriage, both the print cartridge and the carriage have corresponding datums for aligning one with the other;

b) engaging a lip on the print cartridge with a guide rail on the carriage;

c) sliding the print cartridge up and over the datum on the carriage with the guide rail; and d) latching the print cartridge in the carriage.

8. The method of claim 7 wherein the step of horizontal translating further includes the step of pitching up the print cartridge with the guide rail.

9. The method of claim 7 wherein the step of horizontal translating further includes the step of pitching down the print cartridge with a latch spring.

10. The method of claim 9 wherein the step of pitching down the print cartridge occurs after the step of pitching up the print cartridge.

11. A method of unloading a print cartridge from a printer carriage, said method comprising steps of:

providing datum surfaces on the printer carriage which are engageable with the print cartridge to pivotally relate the print cartridge at a forward end thereof to the printer carriage; rotating said print cartridge about said datum surfaces on the carriage;

in response to said rotating of said print cartridge unlatching said print cartridge from said carriage;

providing a horizontally extending guide rail on said carriage, and providing a laterally extending lip on said print cartridge;

utilizing a cooperative sliding engagement of said laterally extending lip of said print cartridge upon the horizontally extending guide rail of said carriage to support said print cartridge; and while said print cartridge is slidably supported cooperatively by said laterally extending lip upon said horizontally extending guide rail, horizontally translating said print cartridge out of said printer carriage.

12. The method of claim 11 wherein said print cartridge has a portion exposed rearwardly from said printer carriage while said print cartridge is received therein and latched into said carriage, and wherein the step of rotating includes the step of manually forcing the exposed rearward portion of the print cartridge downwardly.

13. The method of claim 11 wherein the step of rotating said print cartridge includes the step of pitching down a forward end of said print cartridge in said printer carriage.

14. The method of claim 11 wherein the step of rotating said print cartridge downwardly at a rear end thereof includes the step of limiting said rotation by effecting cooperative engagement of said print cartridge lip upon said printer carriage guide rail.

15. A print cartridge which is insertable substantially horizontally into a carriage receiving pocket, the carriage receiving pocket being received between a pair of vertically spaced apart upper and lower horizontally extending planes which effectively constrain vertical movements of the print cartridge between said pair of planes, said print cartridge comprising:

said print cartridge having a horizontally insertable low profile print cartridge body, said print cartridge body having structural features enabling complete insertion of the print cartridge body into said carriage receiving pocket with a predominately horizontal motion between said pair of upper and lower constraining planes, and said low profile of said print cartridge body resulting from said print cartridge body having its major dimension along an axis aligned with the horizontal motion of the print cartridge into said carriage;

said print cartridge further having a pair of laterally extending and horizontally elongate lips extending parallel to said major dimension, said pair of lips being engageable slidably onto a horizontal guide rail of the carriage to guide said print cartridge horizontally between said constraining planes into and out of said carriage.

16. The print cartridge of claim 15, wherein the receiving pocket includes a guide rail and wherein the mechanical features include a lip for engaging the guide rail.

17. The print cartridge of claim 15 wherein the receiving pocket includes a carriage latch feature, the print cartridge body includes a top wall having a corresponding latch feature for engaging the carriage latch feature.

18.The print cartridge of claim 17, wherein the latch feature is spaced from any edges of the top wall.

19. The print cartridge of claim 15, wherein the mechanical features also enable rotation of the print cartridge about a datum on the carriage and unlatching of the print cartridge from the carriage.

20. An especially configured thermal inkjet print cartridge, which is insertable into a carriage receiving pocket of a printing system by horizontal movement between a pair of vertically spaced apart horizontally extending constraining planes which are closely aligned with respective upper and lower extents of said carriage pocket, said print cartridge comprising:

a generally rectangular prismatic cartridge body having a length dimension, a width dimension, and a height dimension, said cartridge body carrying a generally horizontally extending and planar print head having an array of vertically extending fine-dimension print orifices from which issues vertically downwardly directed droplets of ink during operation of said print cartridge, and said cartridge body having said length dimension, which defines a major axis for said prismatic body, disposed along said horizontal direction of installation of said cartridge body into said carriage receiving pocket; whereby, said specially configured print cartridge allows for a low profile printing system.

21. The print cartridge of claim 20, wherein said cart ridge body includes a front wall having a plurality of electrical contacts for energizing said cartridge upon installation of said cartridge into the printing system, a back portion opposite to said front wall and providing for grasping and force application by a user during installation of said print cartridge horizontally into said carriage receiving pocket, and wherein said major axis extends between said front wall and said back portion.

22. The print cartridge of claim 20, further comprising a top wall spanning the major axis and having a latch feature disposed thereon.

23. The print cartridge of claim 20 further comprising a top wall joining the front and back walls and having a latch feature thereon.

24. Apparatus structurally configured for horizontally loading and unloading a print cartridge into and from a printer carriage, said apparatus comprising:

said print cartridge having: a generally rectangular prismatic print cartridge body having a major axis which is elongate in a horizontal direction from front to rear of said print cartridge, and a print head disposed on a bottom wall of said print cartridge, a pair of elongate horizontally extending and laterally oppositely extending supporting lips located on said print cartridge body;

said carriage having: a carriage body with a generally horizontally extending chute horizontally receiving said print cartridge, said chute having a horizontally spaced apart and horizontally elongate pair of guide rails for respectively slidably engaging said elongate supporting lips on said print cartridge for guiding said print cartridge horizontally into and horizontally out of said carriage chute in a direction which is parallel to said major axis of said print cartridge.

25. The apparatus of claim 24 wherein said pair of horizontally extending rails are arcuate.

26. The apparatus of claim 24 wherein said pair of horizontally extending r ails are inclined slightly upwardly toward a forward end of said print cartridge with respect to movement of said print cartridge into said chute.

27. A method of horizontally loading and unloading a print cartridge into and from a printer carriage, said method comprising steps of:

providing said print cartridge with a print cartridge body which is of rectangular prismatic shape with a horizontally elongate major dimension, and disposing a print head on a lower surface of said print cartridge body;

providing a pair of horizontally extending and elongate and laterally extending opposite lips on said print cartridge body;

providing on said printer carriage a pair of horizontally spaced apart and horizontally elongate guide rails extending inwardly of said printer carriage, configuring said pair of guide rails to be inclined slightly upwardly in the forward direction of said print cartridge into said carriage, and configuring said pair of guide rails to be slightly arcuate in an upwardly convex direction;

translating said print cartridge horizontally forward into said carriage, with said pair of lips each in sliding and supporting relationship with a respective one of said pair of guide rails; providing on both said print cartridge and said carriage corresponding datum surfaces for aligning one with the other, and for providing a pivotal inter-engagement of said print cartridge with said carriage;

sliding said print cartridge into engagement with said datums on said carriage by substantially horizontal sliding movement of said pair of print cartridge lips along said pair of guide rails of said carriage;

latching said print cartridge in said carriage by an upward pitching motion of a rear end of said print cartridge; and unlatching and horizontally removing said print cartridge from said carriage by a reversal of the above-recited steps.

* * * * *